United States Patent [19]

Schaeff

[11] Patent Number: 4,632,595

[45] Date of Patent: Dec. 30, 1986

[54] QUICK-CHANGE COUPLER

[76] Inventor: Hans Schaeff, Seestr. 172, 7183 Langenburg, Fed. Rep. of Germany

[21] Appl. No.: 597,414

[22] Filed: Apr. 6, 1984

[30] Foreign Application Priority Data

Apr. 7, 1983 [DE] Fed. Rep. of Germany ..... 3312442

[51] Int. Cl.[4] ..... F16B 21/02

[52] U.S. Cl. ..... 403/330; 403/322; 403/353; 403/92; 414/723; 292/108

[58] Field of Search ..... 403/330, 322, 325, 321, 403/99, 92, 91, 106, 353, 326; 292/210, 108; 414/723

[56] References Cited

U.S. PATENT DOCUMENTS

| | | | |
|---|---|---|---|
| 3,934,738 | 1/1976 | Arnold | 414/723 |
| 4,136,792 | 1/1979 | Wilson | 403/353 X |
| 4,187,050 | 2/1980 | Barbee | 403/92 X |
| 4,214,840 | 7/1980 | Beales | 403/322 X |
| 4,436,477 | 3/1984 | Lenertz et al. | 414/723 |
| 4,452,560 | 6/1984 | Coyle et al. | 414/723 |
| 4,496,260 | 1/1985 | Brunn | 403/353 X |

*Primary Examiner*—Cornelius J. Husar
*Assistant Examiner*—Joseph A. Fischetti
*Attorney, Agent, or Firm*—Shlesinger, Arkwright, Garvey & Fado

[57] ABSTRACT

A quick-change coupler for the work implements of an excavator beam with an adjustable support frame (4) at the beam, said support frame receiving by means of a hook jaw a cross-pipe fixed to the tool. The hook (6) widens starting at its tip and is provided on its backside with a slanted surface (7) cooperating with a corresponding bevel (23) at the tool in order that, after the engagement between hook and cross-pipe (21) and further pivoting of the support frame (4), this support frame be automatically centered until it is locked with respect to the tool.

27 Claims, 4 Drawing Figures

QUICK-CHANGE COUPLER

BACKGROUND OF THE INVENTION

The invention concerns a quick-change coupler for work implements attached to an excavator-beam, a loader arm or similar tool holder. A support-frame (4) is adjustable at the tool-holder and a hook (6) issuing from the support frame and provided with a hook jaw (16) and a free backside and a rest surface (15) is mounted at the support frame behind the hook and a locking means (9). Further, a cross-pipe (21) is mounted to the tool and is associated with the hook jaw and acts as a receiving means. A stop plate (22) cooperates with the rest surface and an intake opening is provided between said stop plate and the cross-pipe whereby, upon a pivoting motion of the support frame, the cross-pipe is seized by the hook jaw and the rest surface (15) is moved against the stop plate (22) and the locking system is actuated.

The British Patent Document GB-A No. 20 40 262 (BEALES STEEL) discloses equipment of the above-stated type which evinces a complex design. A substantial number of pin-means and projections with recesses or clearances must be mutually engaged between the tool holder and the tool before the tool can be locked into the tool holder. When the cross-pins of the tool holder are pressed against the tool to achieve coupling, there is the danger of minor alignment errors such that the tool may roll off. Accordingly, the machine operator encounters substantial difficulties during the receiving procedure.

Similar difficulties are encountered when using the quick-change coupler known from the German Offenlegungsschrift No. 25 13 772 (WAIN-ROY). The pins and the projections are provided at the tool and their associated receiving means, in the form of a hook jaw and a separately arranged hollow are in the tool holder. If the tool is set on uneven terrain or on a slippery foundation, such as gravel or chippings, then the locking at the tool holder requires auxiliary personnel. Excavation includes operations wherein the tool is loaded in all possible directions, including that in which the hook jaw is open. An additional projection means and a receiving means at the tool and the tool holder respectively are provided to absorb the loads in the just-above cited direction. A more complex design, with increased manufacturing costs on one hand and on the other the described coupling problems, necessarily is the result.

OBJECTS AND SUMMARY OF THE INVENTION

The object of the invention, accordingly, is an improved quick-change coupler system of the initially described kind by means of which the exchanging of the work implement is simplified both functionally and as regards the related construction thereof, fewer components are required. This design assures that by means of a single locking element both an engagement following the first preliminary latching of the hook into its associated receiving means and an automatically ensuing centering engagement until full coupling—as well as all tool loads—are absorbed by the support frame and hence by the machine.

This object is realized by the invention by the characterizing steps of claim 1.

The simplified design of the quick-change coupler of the invention is due to the fact that the hook issuing from the tool holder encloses not only the cross-pipe but also is equipped on its backside with the bevelled seating surface. The hook, upon assuming a certain engaging position and in cooperation with the opposite bevel of the stop plate of the tool, acts as a rest, whereby from the start a staticly determined fixation of the quick-change coupler is achieved when considering the coupling procedure with a unilaterally applied actuation force. While the coupling takes place, and as the mutual engaging procedures are being completed, the locking latch known per se also becomes operative and advantageously acts on the other end of the stop plate which is designed as the matching locking part. The stop plate is an especially simple component and thereby it is important to the simple design of the quick-change coupler. Due to its position on the tool receiving means it decisively contributes to said means stiffening and strength. The strength of the receiving means is further enhanced by this means, which consists very simply of two side parts or side plates, which are made rigid not only by the relatively transverse stop plate but also by the cross-pipe. Therefore, the receiving means required for the quick-change coupler does not require any especially significant changes because the strength of the receiving means is met by practically the same components which also are provided for the strength of the work implement.

The latch may be provided between its ends with an actuation arm comprising an opening to receive a manually actuated tommy bar. Said actuation arm is mounted at about 180° from the locking arm of the latch.

In another embodiment of the quick-change coupler of the invention, the stop mounted in the path of an actuation arm of the latch is designed to be a hydraulic plunger which is guided in a hydraulic cylinder mounted to the side plate of the support frame. Upon the cylinder being loaded, this plunger will overcome the latch spring force and pivot the latch into its unlocked position.

Further features and advantages of the invention will be found in the description below of an illustrative embodiment of the quick-change coupler of the invention and of its modes of embodiment, in relation to the drawings showing significant details of the invention, furthermore in the claims. The particular features of the claims can be realized singly or in arbitrary combinations when embodying the invention.

DESCRIPTION OF THE INVENTION

Figure 2:
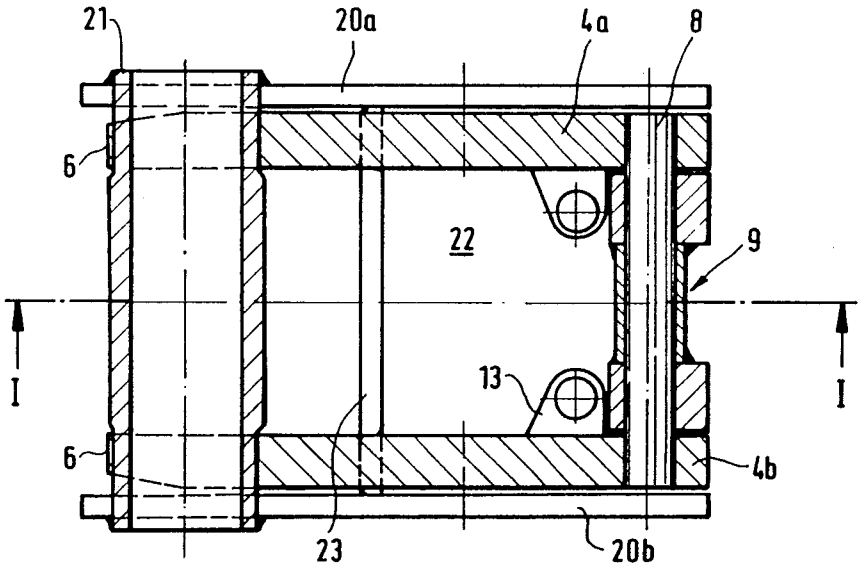
FIG. 2 is a partial topview of the work implement along a section along line 11—11 of FIG. 1.

A support frame 4 is mounted by pivot bolts or bearings 3*a* and 3*b* to an excavator or loader arm or lever 1 and 2 respectively. The support frame consists of two side plates 4*a*, 4*b*, as best shown in FIG. 2, mutually connected by one or more cross ties, for instance by a pipe section 5.

Figure 1:
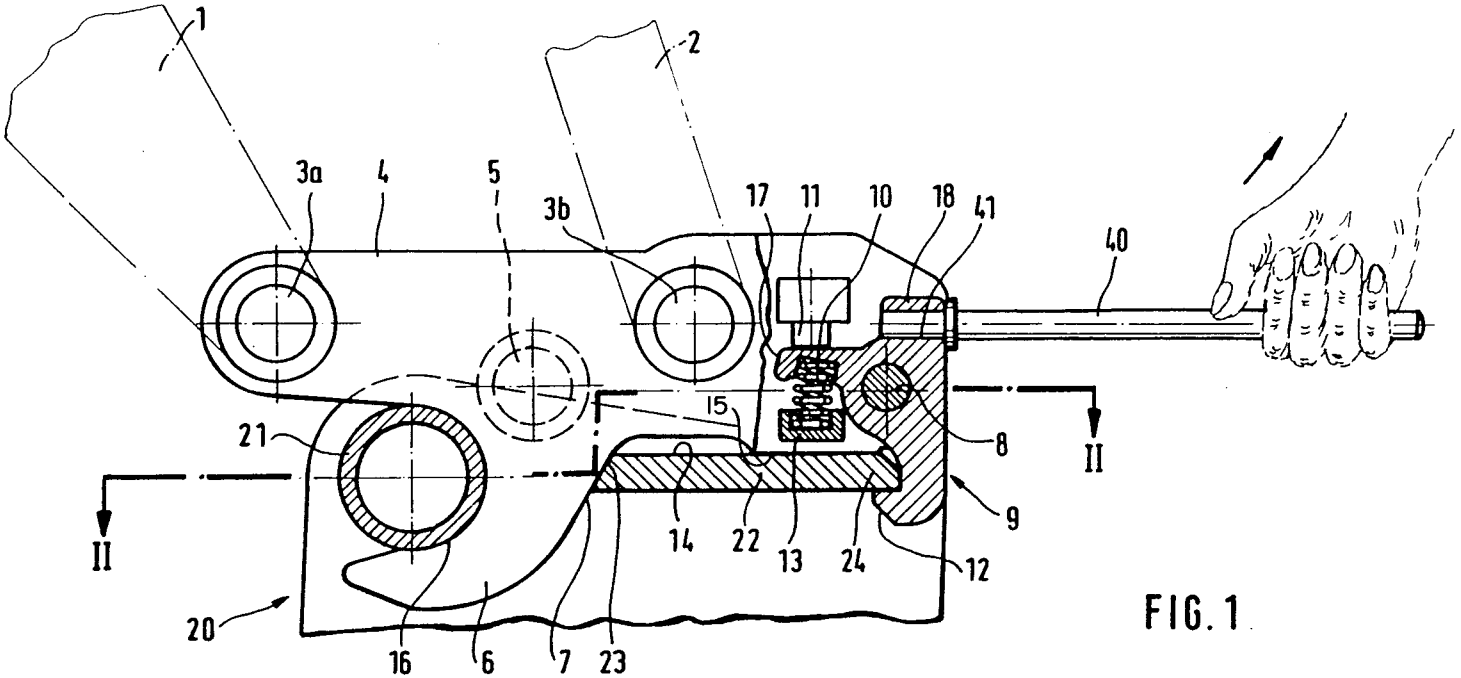
FIG. 1 is a partial sideview of an embodiment of the quick-change coupler of the invention shown in the engaged positions of the support frame and the tool receiving means.
Figure 3:
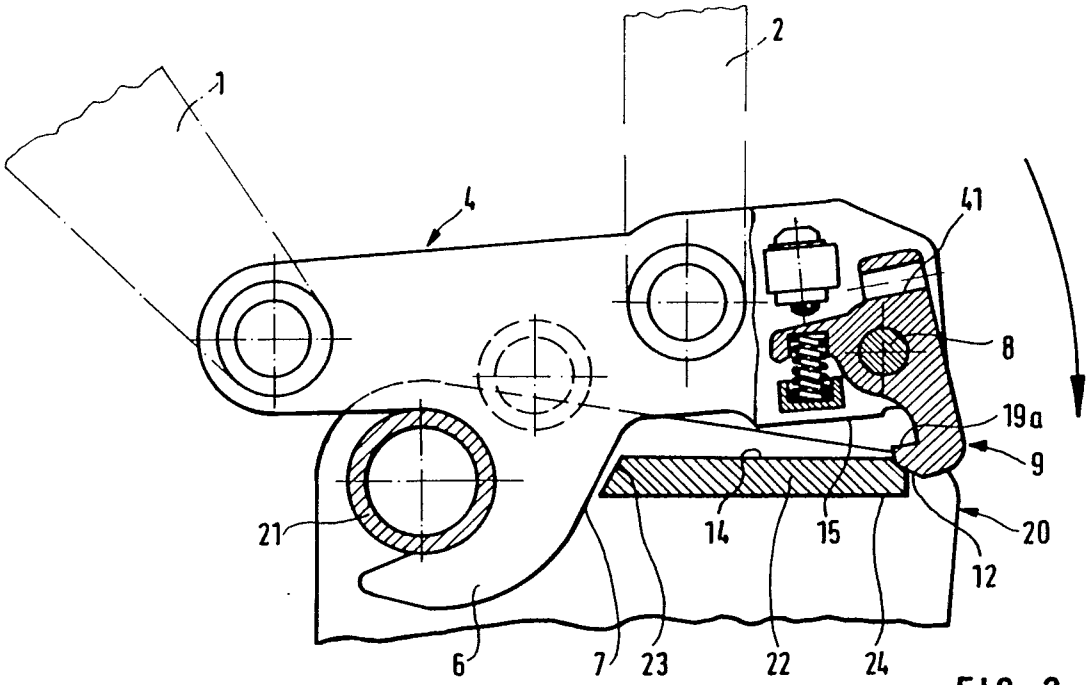
FIG. 3 is a sideview similar to that of FIG. 1 but at the time of the articulating engagement between the support frame and the tool receiving means prior to the action by the locking latch, and FIG. 4 again is similar to FIG. 1, showing a relative position of the support frame and the tool receiving means after the locking latch was opened.
Figure 4:
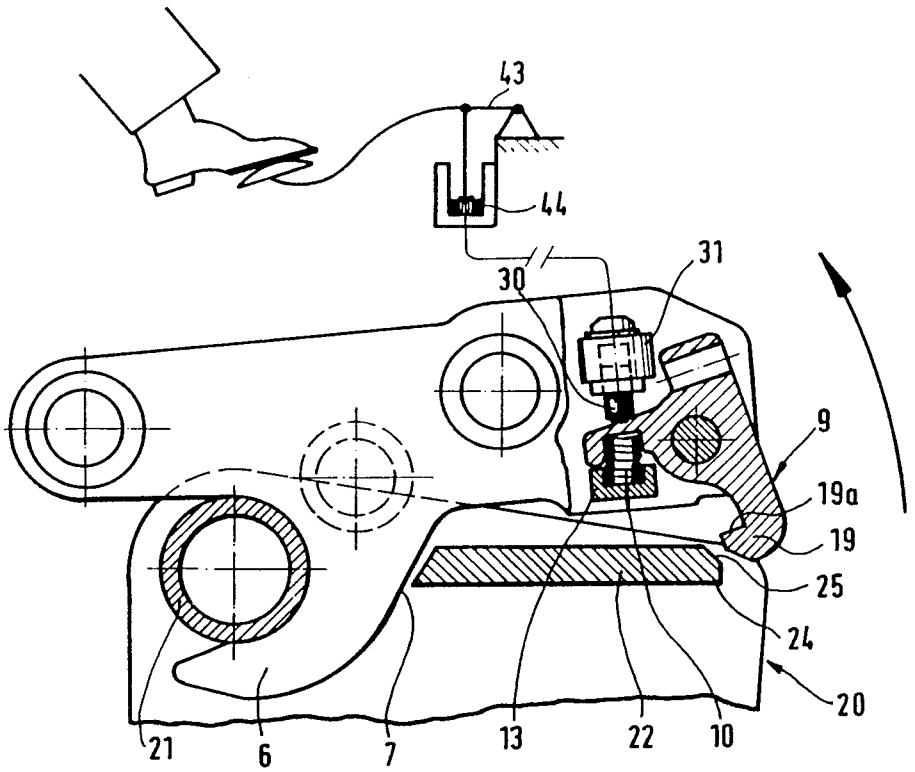

As shown in FIG. 1, the side plates are each designed as a hook 6 which encloses a cross pipe 21. Each hook 6 is provided at its inside with a corresponding semicircular seating surface 16 to receive cross-pipe 21 seated on the tool. On their backside, the hooks 6 are provided with a slanted surface 7 which, as indicated in FIGS. 3 and 4, is in a plane over a specific segment.

A latch 9 is pivotably held about a shaft 8 at the other end of the side parts 4*a*, 4*b* of the support frame. The latch includes a first actuation arm 17 which is acted on by one or more springs 10 in order to load the arm against stop 11. The loading springs 10 rest against an offset starting at each of the side plates, and corresponding stops 11 are also mounted on the side plates 4*a* and 4*b* respectively. The latch proper includes a bevel 12 which allows it to pivot while touching a matching bevel 25 on the tool until it arrives in an end position. In the end position it is held by a second stop 13, this second stop simultaneously acting as a rest for the loading spring 10.

The work implement, for instance an excavator shovel or a loader shove, is provided with a receiving means 20 comprising two side webs 20*a*, 20*b* which are parallel to the side parts of the support frame 4. The side webs are integrally joined by cross-pipe 21 and by stop plate 22 and they are spaced a distance from each other adequate to be received in the support frame 4, as best shown in FIG. 2. The cross-pipe is mounted in accordance with FIG. 1 so that its center axis is approximately in the extension of the center plane of the stop plate 22. The hook 6 of the support frame 4 is engaged in the spacing between the cross-pipe 21 and the stop plate 22. The stop plate 22 furthermore connects the two side webs 20*a*, 20*b* and one of its ends 23 serves as a rest for the slanted surface 7 of the hook 6.

When the support frame 4 is moved close to the tool receiving means 20, then the lower side of the support frame, which is designed as the stop surface 15, comes to rest against the top side 14 of the stop plate 22. At this time, the latch 9 also has overlapped the other side of the stop plate 24 which is provided with the slanted surface 25. In this condition, the slanted surface 25 presses the hook 6 in an essentially play-free manner onto the cross-pipe 21.

FIG. 3 shows the sequence of steps in coupling the support frame and the tool receiving means. The support frame 4, together with the hook 6, is hooked into the tool and into the opening between the cross-pipe 21 and the stop plate 22 and is then pivoted clockwise about the cross-pipe 21 until the latch 9 engages, i.e. until it has overlapped the stop plate 22. FIG. 3 shows the instant at which the latch 9 makes contact by its slanted surface 12 with the matching slanted surface 25 of the stop plate 22 and whereby the shaft 8 is rotated counterclockwise and against the force of the loading spring 10.

To disengage the quick-change coupler, the latch 9 may be equipped between its ends with a second actuation arm 18 which has an opening in order to receive a manually actuated tommy bar by means of which the latch is manually raised and disengaged. The second actuation arm 18, preferably, is mounted at about 180° from the locking arm or the latch hook.

FIG. 4 shows the disengaging procedure in closer detail. The stop mounted in the path of the first actuation arm 17 of the latch 9 is designed as a hydraulic plunger 30. It is forced against the stop 13 and overcomes the opposing force of the loading spring 10, whereupon the support frame 4 is pivoted counterclockwise as indicated by the arrow direction.

It is possible to guide the plunger in a hydraulic cylinder 31 which mounted to the side plate of the support frame 4. Upon applying a load to the cylinder and overcoming the spring force, the plunger will pivot the latch into its unlocked position. The oil pressure required to move the plunger 30 can be generated by hand or foot by the machine operator. Preferably, this pressure is generated by actuating a foot or hand lever 43, in the manner indicated, using the displacement of oil by means of a small displacing piston 44 and thereby eliminating any additional motor hydraulics otherwise required.

A particular consideration for the manual uncoupling indicated in FIG. 1 in this procedure consists in it always being operational without danger. The work implement remains fixed in place by the cross-pipe 21 connected to it, namely in the hooks 6 mounted in the two side plates of the support frame 4.

It is further of significance for the simple design and construction and simple operation of the quick-change coupler of the invention that the hook 6 continuously widens from its tip toward the connection to the side webs 4*a*, 4*b* of the support frame 4. In other words, as seen in FIG. 1, straight lines drawn from the center of the cross-pipe 21 to the backside of the hook 6 become increasingly longer, especially across the rear slanted surface 7 of the hook 6. If, therefore, the hook, which is initially thin at its tip, slips upon nearing and pivoting of the support frame 4 into the space between the cross-pipe 21 and the stop plate 22, then there will occur with increasing pivoting motion a self-centering operation in such a manner that, for instance, the hook sliding along the slanted surface 23 of the stop plate 22 is displaced toward the cross-pipe 21 until it seizes the cross-pipe 21, by means of the seating surface 16, in essentially play-free manner. At that instant, the locking operation between the support frame 4 and the receiving means 20 has proceeded to such an extent that independent relative motions in a direction essentially parallel to the plane of the stop plate are no longer possible. Relative pivotal motions of the support frame 4 in the clockwise direction corresponding to FIG. 1, or counterclockwise of the receiving means 20, are prevented by the mutually opposite stop surfaces 14 of the stop plate and 15 of the side plates 4*a*, 4*b*. Relative pivotal motions in the opposite directions are prevented by the hook part 19 of the latch 9 overlapping the end segment of the stop plate 22 which is designed to be the matching lock means 24. In this manner, the latch 9 is reliably loaded only in a single direction during tool operation, this direction furthermore being one along which hardly any significant loads take place during the excavation of a shovel excavator or during the loading of a shovel loader.

What I claim is:

1. A quick change coupler for tool using equipment, comprising:

(a) a movable support frame having front and rear end portions associated with the equipment and including hook means proximate said front end portion and said hook means having a hook jaw and a backside;

(b) latch means pivotally secured to said support frame and rearwardly spaced from said hook means, said latch means including a latch arm pivotal between a latched and an open position;

(c) receiving means having front and rear end portions associated with a tool;

(d) cross-pipe means secured to said receiving means proximate said front end portion of said receiving means and adapted for being received in said hook jaw; and, (e) stop means secured to said receiving means and rearwardly spaced from said cross-pipe means and forming a passage therebetween for receiving said hook means and including a first surface proximate said receiving means front end portion for cooperating with said backside and a second surface proximate said receiving means rear end portion for cooperating with said latch means;

(g) whereby receipt of said cross-pipe means in said hook jaw causes said first surface to engage said hook backside so that said latch arm may be pivoted into said latched position by engagement with said second surface and to thereby secure the tool to said support frame.

2. The coupler as defined in claim 1, wherein:

(a) said backside having a portion thereof slanted; and, (b) said first surface being beveled complementary to said backside slanted portion so that said first surface abuts said slanted portion.

3. The coupler as defined in claim 2, wherein:

(a) said second surface having a beveled portion and said latch arm having a beveled portion complementary to said second surface beveled portion so that said latch arm is free to pivot about said stop plate.

4. The coupler as defined in claim 1, wherein:

(a) said latch means including first and second latch arms; and, (b) biasing means being associated with said first latch arm for biasing said second latch arm into said latched position.

5. The coupler as defined in claim 1, wherein:

(a) said support frame including first and second spaced parallel side plates; and, (b) means interconnecting said side plates.

6. The coupler as defined in claim 5, wherein:

(a) a shaft extending between said side plates; and, (b) said latch means being mounted to said shaft.

7. The coupler as defined in claim 1, wherein:

(a) said receiving means including first and second spaced parallel side webs;

(b) said cross-pipe means being secured to and extending between said side webs; and, (c) said stop plate being secured to and extending between said side webs.

8. The coupler as defined in claim 5, wherein:

(a) said receiving means comprising first and second spaced parallel side webs and said cross-pipe means and said stop plate being secured to and extending between said side webs; and, (b) said side webs being spaced apart a distance exceeding the distance said side plates are separated so that the support frame is receivable in said receiving means.

9. The coupler as defined in claim 1, wherein:

(a) said stop plate being planar; and, (b) the axis of said cross-pipe being positioned within the plane of said stop plate.

10. The coupler as defined in claim 4, wherein:

(a) a first stop being secured to said support frame proximate said first latch arm for positioning said biasing means.

11. The coupler as defined in claim 10, wherein:

(a) said biasing means including a spring.

12. The coupler as defined in claim 10, wherein:

(a) a second stop being secured to said support frame proximate said first latch arm for preventing pivoting of said latch means more than a predetermined amount.

13. The coupler as defined in claim 1, wherein: ;p1 (a) means being associated with said latch means for pivoting said latch arm from said latched to said open position for thereby releasing the tool from said support frame.

14. The coupler as defined in claim 12, wherein:

(a) said second stop including an hydraulic plunger engaged with said first latch arm for pivoting said latch means between said latched and said open position; and, (b) hydraulic operating means being operably associated with said plunger for operating said plunger and thereby causing pivoting of said latch means.

15. The coupler as defined in claim 1, wherein:

(a) said stop plate including an upper and a lower side; and, (b) said latch arm including a hook surface engaged with said lower side when in said latched position.

16. A quick change coupler for tool using equipment, particularly for excavator beams, loader arms and the like, comprising:

(a) a support frame associated with the equipment and comprising first and second spaced parallel side plates with front and rear end portions, each of said side plates including a hook with a hook jaw and a backside and said hooks proximate the front end portion of said plates and said plates each including a rest surface rearward of the associated hook;

(b) means interconnecting said side plates;

(c) a shaft extending between said side plates proximate said rest surfaces;

(d) a latch including first and second latch arms pivotally mounted to said shaft and pivotal between a latched and an open position;

(e) receiving means with front and rear end portions associated with a tool and comprising first and second spaced parallel side webs, said side webs spaced apart a distance exceeding the distance separating said side plates so that said support frame is receivable in said receiving means;

(f) a cross-pipe secured to and extending between said side webs proximate the front end portions of said side webs and adapted for being received within said hook jaw; and, (g) a stop plate secured to and extending between said side webs and spaced rearwardly of said cross-pipe, said stop plate including a first surface for cooperating with said hook backside positioned proximate said receiving means front end portions and a second surface for cooperating with said latch proximate said receiving means rear end portions;

(h) whereby receipt of said cross-pipe in said hook jaws causes said first surface to engage said backsides so that said latch may be pivoted into said latched position so that an arm thereof engages said second surface and thereby secures the tool to said support frame.

17. The coupler as defined in claim 16, wherein:

(a) biasing means being associated with said first latch arm for biasing said latch into said latched position.

18. The coupler as defined in claim 16, wherein:

(a) said stop plate being planar;

(b) the axis of said cross pipe being positioned within the plane of said stop plate; and, (c) said shaft being spaced a distance from the plane of said stop plate.

19. The coupler as defined in claim 16, wherein:

(a) means being associated with said latch for pivoting said latch from said latched to said open position for thereby releasing a tool from said support frame.

20. The coupler as defined in claim 19, further comprising:

(a) an hydraulic plunger being secured to said support frame proximate said latch and engaged with said first latch arm; and, (b) hydraulic operating means operably associated with said plunger for causing movement of said plunger and thereby pivoting of said latch between said open and latched positions.

21. A quick change coupler for tool using equipment, comprising:

(a) a movable support frame associated with the equipment and including hook means proximate the front end thereof and said hook means having a hook jaw and a backside and said frame further including a rest surface rearward of said hook means;

(b) latch means pivotally secured to said support frame and rearwardly spaced from said hook means, said latch means including a latch arm pivotal between a latched and an open position;

(c) receiving means associated with a tool;

(d) cross-member means secured to said receiving means proximate the front end thereof and adapted for being received in said hook jaw; and, (e) stop means secured to said receiving means and rearwardly spaced from said cross-member means to form a passage therebetween for receiving said hook means, said stop means including a first surface for cooperating with said hook backside, a second surface for cooperating with said latch means, and a third surface for cooperating with said rest surface;

(g) whereby receipt of said cross-member means in said hook jaw causes said first surface to engage said hook backside and said third surface to engage said rest surface so that said latch arm may be pivoted into said latched position to engage said second surface and thereby secure the tool to said support frame.

22. The coupler as defined in claim 21, wherein:

(a) said hook backside having a portion thereof slanted; and, (b) said first surface being beveled complementary to said backside slanted portion so that said first surface abuts said slanted portion.

23. The coupler as defined in claim 22, wherein:

(a) said third surface having a beveled portion and said latch arm having a beveled portion complementary to said third surface beveled portion so that said latch arm is free to pivot about said stop means.

24. The coupler as defined in claim 21, wherein:

(a) said stop means including a planar stop plate; and, (b) the axis of said cross-member being positioned within the plane of said stop plate.

25. The coupler as defined in claim 21, wherein:

(a) means being associated with said latch means for pivoting said latch arm from said latch to said open position for thereby releasing the tool from said support frame.

26. The coupler as defined in claim 24, wherein:

(a) said stop plate having an upper and a lower side; and, (b) said latch arm including a hook surface engaged with said lower side when in said latched position.

27. The coupler as defined in claim 21, wherein:

(a) biasing means being associated with said first latch arm for biasing said latch into said latched position.

* * * * *